US006135717A

United States Patent [19]

Sokol et al.

[11] Patent Number: 6,135,717

[45] Date of Patent: Oct. 24, 2000

[54] LOCK FOR MOVING BLADES OF A TURBINE ROTOR

[75] Inventors: Bernd Sokol, Burgthann; Horst Müller, Weinberg; Georg Feeder, Nürnberg; Gerd Rupprecht, Leinburg, all of Germany

[73] Assignee: ABB Patent GmbH, Mannheim, Germany

[21] Appl. No.: 09/335,367

[22] Filed: Jun. 17, 1999

[30] Foreign Application Priority Data

Jun. 17, 1998 [DE] Germany ..... 198 26 897

[51] Int. Cl.[7] ..... F01D 5/37

[52] U.S. Cl. ..... 416/220 R

[58] Field of Search ..... 416/215, 216, 416/217, 218, 220 R, 221

[56] References Cited

FOREIGN PATENT DOCUMENTS

| | | | |
|---|---|---|---|
| 3028701 | 2/1982 | Germany | 416/220 R |
| 659592 | 10/1951 | United Kingdom . | |
| 704882 | 3/1954 | United Kingdom | 416/216 |

*Primary Examiner*—Edward K. Look
*Assistant Examiner*—Liam McDowell
*Attorney, Agent, or Firm*—Herbert L. Lerner; Laurence A. Greenberg; Werner H. Stemer

[57] ABSTRACT

A lock is provided for closing an entry point of a circumferential slot undercut on both sides and intended for accommodating blade roots of moving blades of a turbine rotor. A filling piece with a contour adapted to the blade roots is supported against a supporting side in the turbine rotor through the use of a fitting piece. A step provided in a base region of the lock serves to axially support the filling piece. The fitting piece may be provided with a slit into which a wedge for expanding the fitting piece can be pressed.

4 Claims, 1 Drawing Sheet

LOCK FOR MOVING BLADES OF A TURBINE ROTOR

BACKGROUND OF THE INVENTION

Field of the Invention

The invention relates to a lock for closing an entry point of a circumferential slot that is undercut on both sides and is intended for accommodating blade roots of moving blades of a turbine rotor, wherein a filling piece has a contour adapted to the blade roots and is supported against a supporting side in the turbine rotor through the use of a fitting piece.

German Published, Non-Prosecuted Patent Application DE 30 28 701 A1 discloses a lock for turbine blading in which moving blades are inserted in a form-locking manner in the circumferential slot of the turbine rotor and the circumferential slot may be undercut in any shape on both sides. A form-locking connection is one which connects two elements together due to the shape of the elements themselves, as opposed to a force-locking connection, which locks the elements together by force external to the elements. At least one entry point is provided on the periphery of the turbine rotor, in which a filling piece is inserted, form-locking with the blade root. A wall of the entry point or gate in the turbine rotor and that side of the filling piece which faces the wall are constructed in such a way as to be inclined at an angle to the blade axis. The closure between the wall of the entry point and the side of the filling piece is effected with a fitting piece which sits tightly in position.

The known lock is suitable in particular for root forms of the moving blades in which the blade roots are fully supported in the axial direction of the turbine rotor at the circumferential slot, for example for hammer-head roots. If the blade root is not fully supported in the axial direction in the circumferential slot, for example in the case of fir-tree or pine-tree roots, the blade root in the lock region may yield to an excessive degree when the filling piece is installed, so that the requisite prestress cannot be produced in the lock. Without prestressing of the lock assembly, the centrifugal-force effect on the inclined side of the lock during operation may not adequately clamp the fitting piece, so that the fitting piece becomes detached from the lock and the lock fails.

SUMMARY OF THE INVENTION

It is accordingly an object of the invention to provide a lock for moving blades of a turbine rotor, which overcomes the hereinafore-mentioned disadvantages of the heretofore-known devices of this general type and which is also suitable for moving blades in which blade roots are not fully supported in axial direction of the turbine rotor at a circumferential slot.

With the foregoing and other objects in view there is provided, in accordance with the invention, in a turbine rotor having a supporting side, moving blades with blade roots, and a circumferential slot undercut on both sides, intended for accommodating the blade roots and having an entry point or gate, a lock for closing the entry point of the slot, comprising a filling piece having a contour adapted to the blade roots; a fitting piece supporting the filling piece against the supporting side; and a base region of the lock having a step for axial support of the filling piece.

In accordance with another feature of the invention, there is provided a wedge to be pressed into a slit formed in the fitting piece for expanding the fitting piece.

In accordance with a further feature of the invention, the fitting piece has at least one aperture formed therein for engagement of a tool suitable for pressing-in the wedge.

In accordance with a concomitant feature of the invention, the at least one aperture is a tapped hole, and a locking screw is screwed into the tapped hole.

The advantages which can be achieved by the invention are in particular the fact that the lock can also be used when fir-tree or pine-tree roots are used as the blade roots, in which case the assembly can be carried out in a simple manner. Even in the case of large lock sizes, the press-in forces required during assembly can be applied manually and are well below the limit values for the admissible mechanical loading of the turbine rotor. The configuration of the lock with a slit fitting piece ensures that the fitting piece is also positioned inside the lock in a predetermined manner in the expanded installation position and in no instance projects above the filling piece, for example.

Unlike the generally known locks for fir-tree or pine-tree roots, it is possible with the device according to the invention to reblade the associated blade ring repeatedly without damaging the turbine rotor in the process or without having to rework the turbine rotor.

Other features which are considered as characteristic for the invention are set forth in the appended claims.

Although the invention is illustrated and described herein as embodied in a lock for moving blades of a turbine rotor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE PREFERRED EMBODIMENTS

Figure 1:
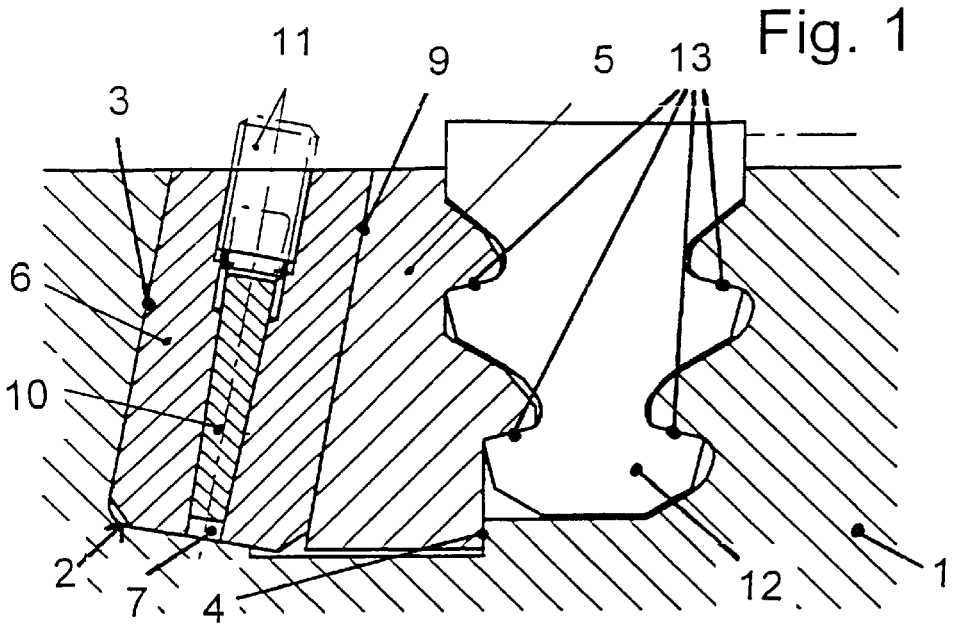
FIG. 1 is a fragmentary, diagrammatic, sectional view of a lock of a turbine rotor, which is taken along a line I—I of FIG. 2, in the direction of the arrows.

Referring now to the figures of the drawings in detail and first, particularly, to FIG. 1 thereof, there is seen a section through a lock 2 of a turbine rotor 1. FIG. 1 is taken along a section line I—I shown in FIG. 2. The lock 2 closes an entry point of a circumferential slot that is undercut on both sides and is intended for accommodating blade roots 12 of moving blades of the turbine rotor 1. In principle, a blade root 12 is supported with the use of a filling piece 5 and a fitting piece 6. The blade root is a fir-tree or pine-tree root in the illustrated example. Axial support is effected directly by the filling piece 5 in the turbine rotor 1 by virtue of the fact that the lock 2 is made in the turbine rotor 1 in such a way that it is deeper than the circumferential slot for the blade root 12, and the filling piece 5 is likewise extended in this region. The filling piece 5 is pressed at a side 9 by the fitting piece 6 against a step 4 which is formed on the turbine rotor 1 and against a blade shoulder, i.e. of the blade root 12. During operation, the moving blades, in the region of the lock as well as in the rest of the circumferential slot, can bear against slightly inclined supporting sides or lateral surfaces 13 on the turbine rotor 1 and be centered.

Figure 2:
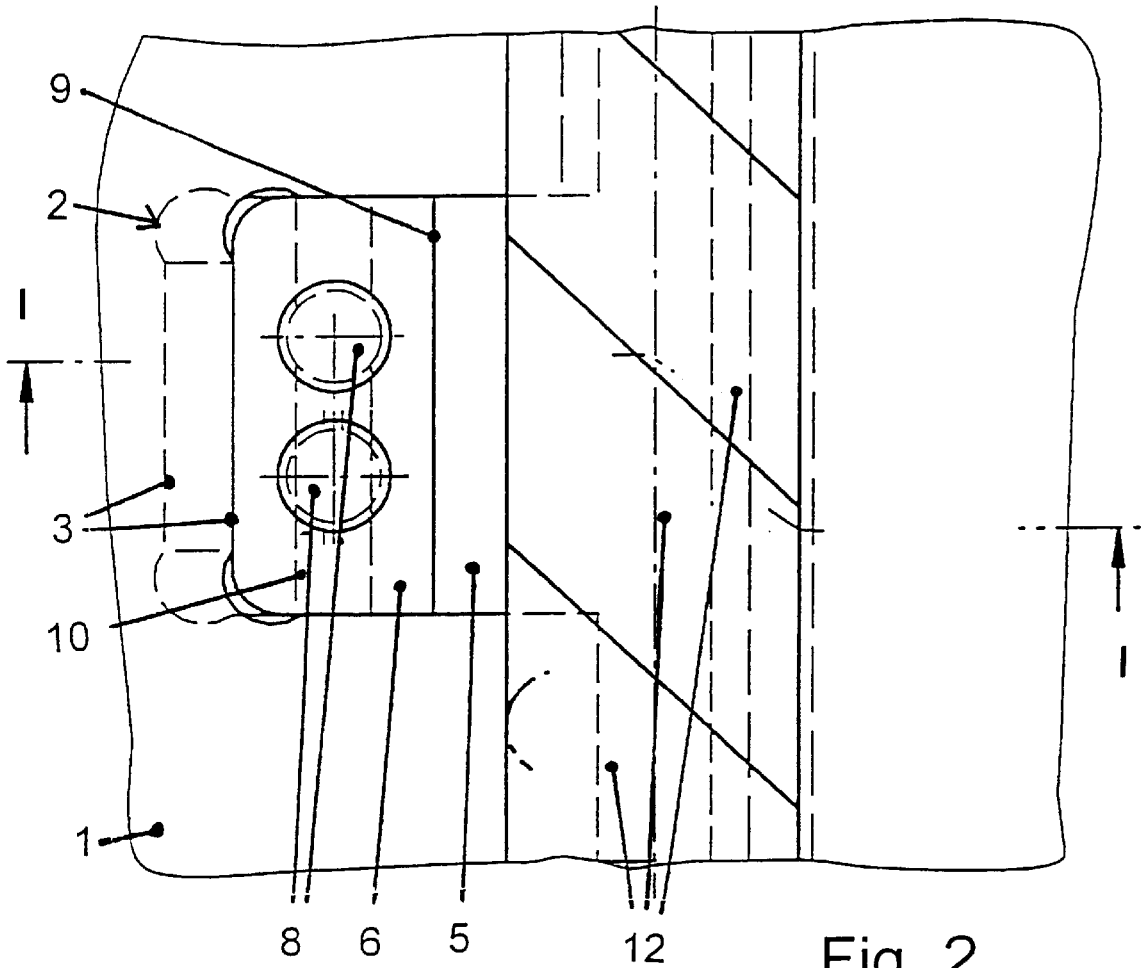
FIG. 2 is a fragmentary, elevational view of the lock of the turbine rotor.

In order to permit expansion of the fitting piece 6, in particular in the case of large lock sizes, in one embodiment the fitting piece 6 is provided with a wedge-shaped slit 7. The slit 7 narrows in the direction of the base region of the lock 2, i.e. in the direction of the axis of the turbine rotor 1. Apertures, preferably tapped holes 8, are made on the top side of the fitting piece 6, opposite the base region, as is seen in FIG. 2. These tapped holes 8 lead into the slit 7 and enable tools to be passed through and screws to be screwed into place.

A supporting side or lateral surface 3 in the turbine rotor 1 is inclined at a slightly larger angle to the radial than the filling piece 5, so that the expanded fitting piece 6 is fastened in a form-locking manner. During assembly, a wedge 10 first of all rests loosely in the slit 7. After the fitting piece 6 is inserted into the lock 2, the wedge 10 is pressed in the direction of the base region of the wedge lock 2 with the use of a suitable tool reaching through the holes 8. As a result, the slit 7 and thus the fitting piece 6 are expanded. The pressed-in wedge 10 is fixed in its position by screwing locking screws 11 (caulked setscrews) into the tapped holes 8.

The slit 7 is preferably made in the fitting piece 6 in one operation together with the wedge 10 by electrical-discharge wire cutting.

Another view of the lock 2 of the turbine rotor 1 is shown in FIG. 2. The position of the blade roots 12 of the moving blades relative to the lock 2 is indicated, with the moving blades disposed next to one another. The filling piece 5, the side 9, the fitting piece 6 with the tapped holes 8 and the supporting side or flank 3 can be seen in the figure. The position of the wedge 10 relative to the tapped holes 8 is also illustrated.

We claim:

1. In a turbine rotor having a supporting side, moving blades with blade roots, and a circumferential slot undercut on both sides, intended for accommodating the blade roots and having an entry point, a lock for closing the entry point of the slot, comprising:

a filling piece having a contour adapted to the blade roots;

a fitting piece supporting said filling piece against the supporting side; and a base region having a step for axial support of said filling piece.

2. The lock according to claim 1, including a wedge to be pressed into a slit formed in said fitting piece for expanding said fitting piece.

3. The lock according to claim 2, wherein said fitting piece has at least one aperture formed therein for engagement of a tool suitable for pressing-in said wedge.

4. The lock according to claim 3, wherein said at least one aperture is a tapped hole, and a locking screw is screwed into said tapped hole.

* * * * *